US005684445A

United States Patent [19]

Kobayashi et al.

[11] Patent Number: 5,684,445

[45] Date of Patent: Nov. 4, 1997

[54] POWER TRANSFORMER

[75] Inventors: Yasuo Kobayashi; Koichi Ueki, both of Saitama, Japan

[73] Assignee: Fuji Electric Co., Ltd., Kawasaki, Japan

[21] Appl. No.: 614,009

[22] Filed: Mar. 12, 1996

Related U.S. Application Data

[63] Continuation-in-part of Ser. No. 389,456, Feb. 16, 1995, abandoned.

[30] Foreign Application Priority Data

Feb. 25, 1994 [JP] Japan ..... 6-027777

[51] Int. Cl.[6] ..... H01F 27/30

[52] U.S. Cl. ..... 336/83; 336/206; 336/223; 336/232

[58] Field of Search ..... 336/83, 200, 206, 336/232, 223

[56] References Cited

U.S. PATENT DOCUMENTS 5,175,525 12/1992 Smith ..... 336/232
5,359,313 10/1994 Watanabe et al. .

FOREIGN PATENT DOCUMENTS 5-166646 7/1993 Japan .
5-166647 7/1993 Japan .
5-166648 7/1993 Japan .

*Primary Examiner*—Thomas J. Kozma
*Attorney, Agent, or Firm*—Kanesaka & Takeuchi

[57] ABSTRACT

A power transformer is formed of a pair of cores having wiring storage portions, at least one primary winding formed of a spirally wound flat ring having a pair of primary leading portions, at least one secondary winding formed of a flat plate, at least one spacer interposed between the flat ring and the flat plate, and an insulation member mounted in the wiring storage portions of the cores. The flat ring, flat plate and at least one spacer for insulating the flat ring and the flat plate are housed in the insulation member. The insulation member has an opening for allowing the primary leading portions to pass therethrough. In order to insulate the primary leading portions from burrs of the secondary winding, a protrusion may be formed on an outer periphery of the spacer to be located under the primary leading portions, or a cut-out portion may be formed in the flat plate.

4 Claims, 6 Drawing Sheets

POWER TRANSFORMER

CROSS-REFERENCE TO RELATED APPLICATION

This is a continuation in part application of patent application Ser. No. 08/389,456 filed on Feb. 16, 1995, now abandoned.

BACKGROUND OF THE INVENTION AND RELATED ART STATEMENT

The present invention relates to a power transformer incorporated into power supplies, such as a switching power supply and so on, as means for transforming electric power.

An example of a conventional power transformer is shown in FIGS. 5 and 6. FIG. 5 is an exploded perspective view, and FIG. 6 is a sectional view of the power transformer of FIG. 5.

In FIG. 5 and 6, cores 1 and 2 include protruding portions 1A and 2A, around which winding storage spaces 1B and 2B are formed respectively. A primary winding 3, which includes leading portions 3A and 3B, is spirally wound to form an annular flat ring, and the leading portion 3A is led out along a flat plane of the annular ring. A secondary winding 5, which includes leading portions 5A and 5B, is a flat plate with a horseshoe shape. Screw holes 5C, 5D for external connection of the secondary winding 5 are bored through the leading portions 5A, 5B. An insulation member 7 is housed in the storage spaces 1B, 2B of the cores 1, 2. The insulation member 7 is formed of a cylindrical inside wall 7A for defining a hole, into which the protruding portions 1A, 2A of the cores 1, 2 are inserted, and an outside wall 7B having openings 7C and 7D.

Reference numerals 8 and 10 designate spacers. The spacer 8 insulates between the primary winding 3 and the core 1, and has a cut-out 8A for leading out the leading portion 3A of the primary winding 3. The spacer 10 insulates between the primary winding 3 and the secondary winding 5. The coupling coefficient and the static capacitance between the primary winding 3 and the secondary winding 5 are set at optimum values by changing the thickness of the spacer 10 for separating the primary winding 3 and the secondary winding 5 to a desired distance.

The power transformer of FIG. 5 is assembled by mounting, in the internal space between the inside and outside walls 7A and 7B, the secondary winding 5, the spacer 10, the primary winding 3 and the spacer 8 in this order. When the secondary winding 5 is mounted, the leading portions 5A, 5B of the secondary winding 5 are led out through the opening 7C of the insulation member 7. The primary winding 3 is mounted such that its leading portions 3A, 3B are led out through the opening 7D of the insulation member 7. The insulation member 7, in which the primary winding 3, the secondary winding 5 and the spacers 8, 10 are mounted in the specific order, is installed on the core 2. At this time, the protruding portion 2A of the core 2 is inserted into the hole surrounded by the inside wall 7A of the insulation member 7.

After mounting the insulation member 7 on the core 2, the protruding portion 1A of the core 1 is inserted into the hole surrounded by the inside wall 7A of the insulation member 7 until the protruding portion 1A of the core 1 contacts the protruding portion 2A of the core 2. Then, the cores 1 and 2 are fixed to each other with an insulating tape and so on. Thus, the power transformer of FIGS. 5 and 6 is completed.

FIGS. 7 and 8 show another example of a conventional power transformer. FIG. 7 is an exploded perspective view, and FIG. 8 is a sectional view of the power transformer of FIG. 7.

The power transformer of FIGS. 7 and 8 is different from the power transformer of FIGS. 5 and 6 in that the primary and the secondary windings are halved, and the halved primary windings 3, 4 and the halved secondary windings 5, 6 are arranged in parallel and are connected respectively outside the power transformer.

A spacer 11 insulates between the halved primary winding 4 and the halved secondary winding 6. A spacer 9 insulates between the halved primary winding 4 and the halved secondary winding 5. A spacer 10 insulates between the halved primary winding 3 and the halved secondary winding 5. And, a spacer 8 insulates between the halved primary winding 3 and a core 1.

The power transformer of FIGS. 7 and 8 is assembled by mounting, in an internal space between an inside wall 7A and an outside wall 7B, the secondary winding 6, the spacer 11, the primary winding 4, the spacer 9, the secondary winding 5, the spacer 10, the primary winding 3 and the spacer 8 in this order.

The power transformer of FIGS. 7 and 8 has the improved conversion efficiency due to the improved magnetic coupling between the primary and secondary windings.

In the conventional power transformers described above, the coupling coefficient and the static capacitance between the primary and secondary windings are set at optimum values by changing the thickness of the spacer for insulating between the primary and secondary windings. Usually, the spacer is formed as thin as possible to greatly increase the coupling coefficient so that the conversion efficiency of the power transformer is improved.

Usually, the flat plate of the secondary winding is fabricated by blanking. If burrs, left on the cut surface of the flat plate of the secondary winding, extend outwardly in the thickness direction of the spacer, the burrs may damage the electric insulation layers formed on the leading portions of the primary winding and cause defective insulation. However, if the burrs are removed, the additional working step for removing the burrs from the cut surface of the secondary winding is required to thereby increase the manufacturing cost of the power transformer.

In view of the foregoing, an object of the present invention is to provide a power transformer, wherein the insulation layers on the leading portions of the primary winding are prevented from being damaged even if the burrs remain on the cut surface of the secondary winding.

SUMMARY OF THE INVENTION

According to a first aspect of the invention, there is provided a power transformer, which comprises: a pair of cores, each having a protruding portion and a wiring storage portion surrounding the protruding portion, the cores being arranged such that the protruding portions and the wiring storage portions face against each other; a primary winding formed of a spirally wound flat ring having a pair of primary leading portions; a secondary winding formed of a flat plate; a spacer interposed between the flat ring and the flat plate; an insulation member mounted in the wiring storage portions of the cores for housing the flat ring and the flat plate to be insulated from each other by the spacer, the insulation member insulating the housed primary winding and the secondary winding from the cores; and a protrusion formed on the outer periphery of the spacer, the protrusion insulating between the primary leading portions of the primary winding and the secondary winding.

According to a second aspect of the invention, there is provided a power transformer, which comprises: a pair of cores, each having a protruding portion and a wiring storage portion surrounding the protruding portion, the cores being arranged such that the protruding portions and the wiring storage portions face against each other; a primary winding formed of a spirally wound flat ring having a pair of primary leading portions; a secondary winding formed of a flat plate; a spacer interposed between the flat ring and the flat plate; an insulation member mounted in the wiring storage portions of the cores for housing the flat ring and the flat plate to be insulated from each other by the spacer, the insulation member insulating the housed primary winding and the secondary winding from the cores; and a cut-out portion formed on the outer periphery of the flat plate, the cut-out portion facing the primary leading portions of the primary winding through the spacer.

According to a third aspect of the invention, there is provided a power transformer, which comprises: a pair of cores, each having a protruding portion and a wiring storage portion surrounding the protruding portion, the cores being arranged such that the protruding portions and the wiring storage portions face against each other; primary windings formed of first and second spirally wound flat rings, each flat ring having a pair of primary leading portions; secondary windings formed of first and second flat plates; spacers, each interposed between the flat ring and the flat plate, the spacers insulating the primary windings and the secondary windings from one another; an insulation member mounted in the wiring storage portions of the cores for housing the first and second flat rings and the first and second flat plates one after the other, the insulation member insulating the housed primary windings and the secondary windings from the cores; and protrusions formed on the outer peripheries of the spacers, each of the protrusions insulating between the primary leading portions of the primary winding and the secondary winding.

According to a fourth aspect of the present invention, there is provided a power transformer, which comprises: a pair of cores, each having a protruding portion and a wiring storage portion surrounding the protruding portion, the cores being arranged such that the protruding portions and the wiring storage portions face against each other; primary windings formed of first and second spirally wound flat rings, each flat ring having a pair of primary leading portions; secondary windings formed of first and second flat plates; spacers, each interposed between the flat ring and the flat plate, the spacers insulating the primary windings and the secondary windings from one another; an insulation member mounted in the wiring storage portions of the cores for housing the first and second flat rings and the first and second flat plates one after the other, the insulation member insulating the housed primary windings and the secondary windings from the cores; and cut-out portions formed on the outer peripheries of the flat plates, each of the cut-out portions facing the primary leading portions of the primary winding through the spacer.

Since the protrusion formed on the outer periphery of the spacer isolates the primary leading portions of the primary winding from the burrs left on the cut surface of the secondary winding, the insulation layers formed on the primary leading portions of the primary winding are prevented from being damaged by the burrs.

Since the portion, facing the primary leading portions of the primary winding, of the flat plate of the secondary winding is withdrawn inwardly from the edge of the spacer by forming the cut-out portion, the insulation layers formed on the primary leading portions of the primary winding are prevented from being damaged by the burrs formed on the cut surface of the secondary winding.

DETAILED DESCRIPTION OF PREFERRED EMBODIMENTS

Now, the present invention will be described in detail hereinafter with reference to the accompanied drawings which illustrate the preferred embodiments of the invention.

Figure 1:
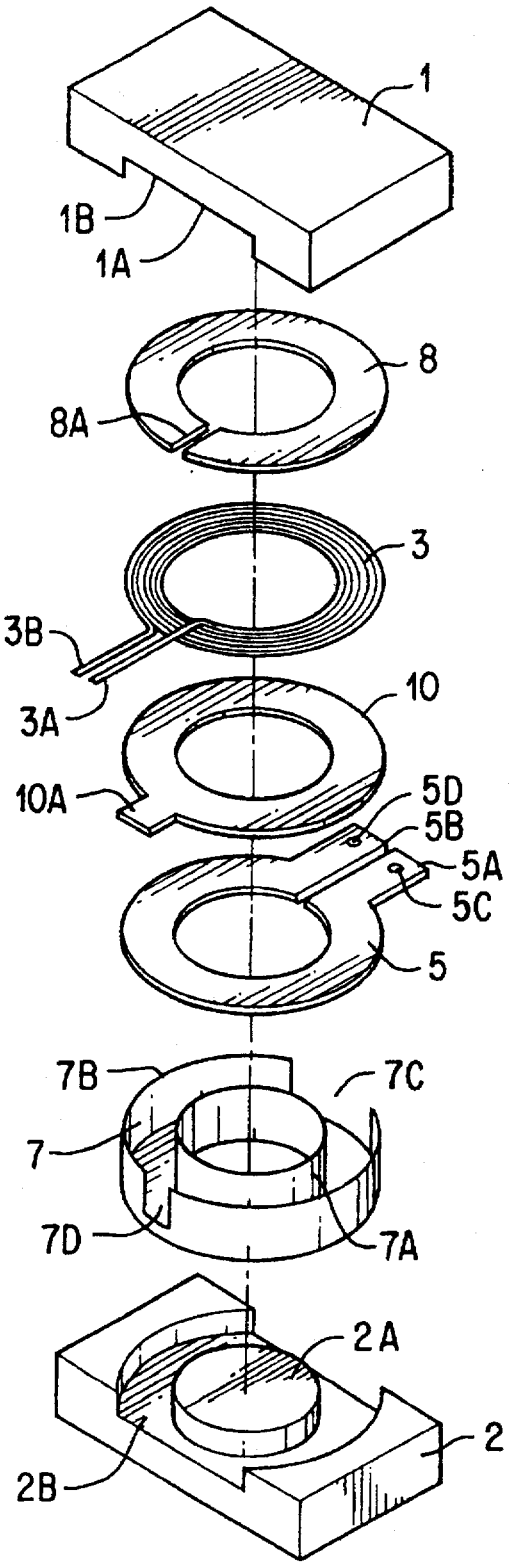
FIG. 1 is an exploded perspective view of a first embodiment of a power transformer according to the present invention.
Figure 5:
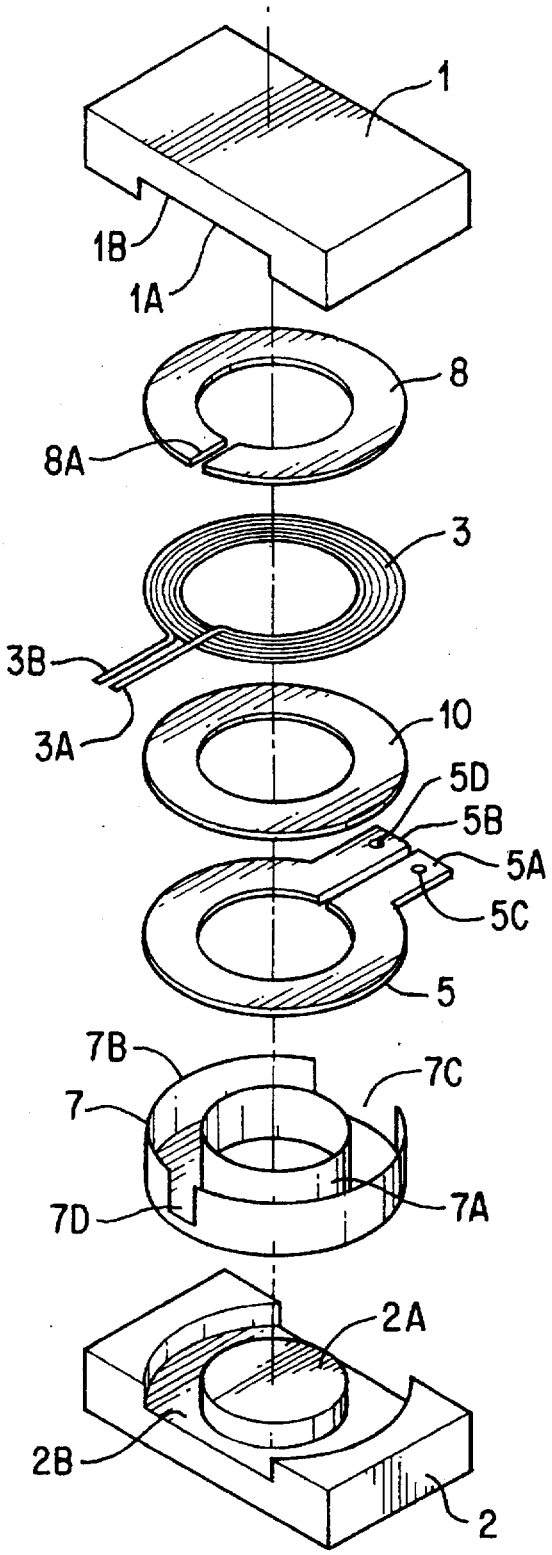
FIG. 5 PRIOR ART
FIG. 5 is an exploded perspective view of one of the conventional power transformers.
Figure 6:
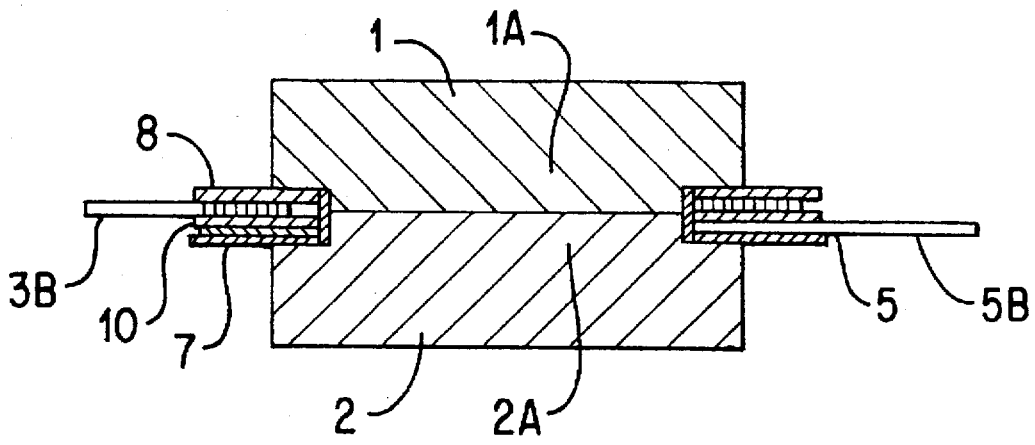
FIG.6 PRIOR ART
FIG. 6 is a sectional view of the power transformer of FIG. 5.

FIG. 1 is an exploded perspective view of a first embodiment of a power transformer according to the present invention. The power transformer of FIG. 1 is different from the conventional power transformer of FIGS. 5 and 6 in that a protrusion 10A is formed on the outer periphery of the spacer 10. The protrusion 10A is formed for isolating between the leading portions 3A, 3B of the primary winding 3 and the secondary winding 5.

If burrs are left on the cut surface of the secondary winding 5, the protrusion 10A isolates the burrs from the leading portions 3A, 3B of the primary winding 3. Therefore, the insulation layers formed on the leading portions 3A, 3B of the primary winding 3 are prevented from being damaged by the burrs, and defective insulation is prevented. The other structures of the power transformer of FIG. 1 is the same as those of the conventional power transformer of FIGS. 5 and 6.

Figure 2:
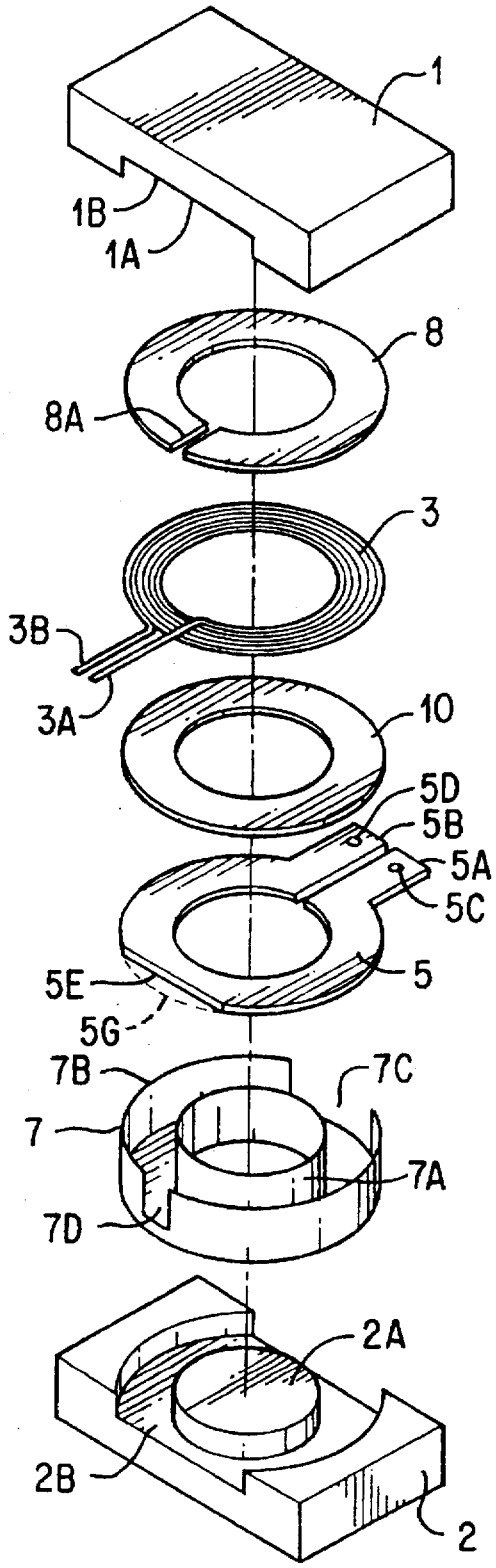
FIG. 2 is an exploded perspective view of a second embodiment of a power transformer according to the present invention.

FIG. 2 is an exploded perspective view of a second embodiment of a power transformer according to the present invention. The power transformer of FIG. 2 is different from the conventional power transformer of FIGS. 5 and 6 in that a portion 5G, facing the leading portions 3A, 3B of the primary winding 3 through the spacer 10, of the secondary winding 5 is cut out.

In the thus formed power transformer of the second embodiment, the cut surface 5E, formed by cutting out the portion 5G of the secondary winding 5, is located inwardly from the edge of the spacer 10. Therefore, the insulation layers formed on the leading portions 3A, 3B of the primary winding 3 are prevented from being damaged by the burrs formed on the cut surface of the secondary winding, and defective insulation is prevented. The other structures of the power transformer of FIG. 2 are the same as those of the conventional power transformer of FIGS. 5 and 6.

Figure 3:
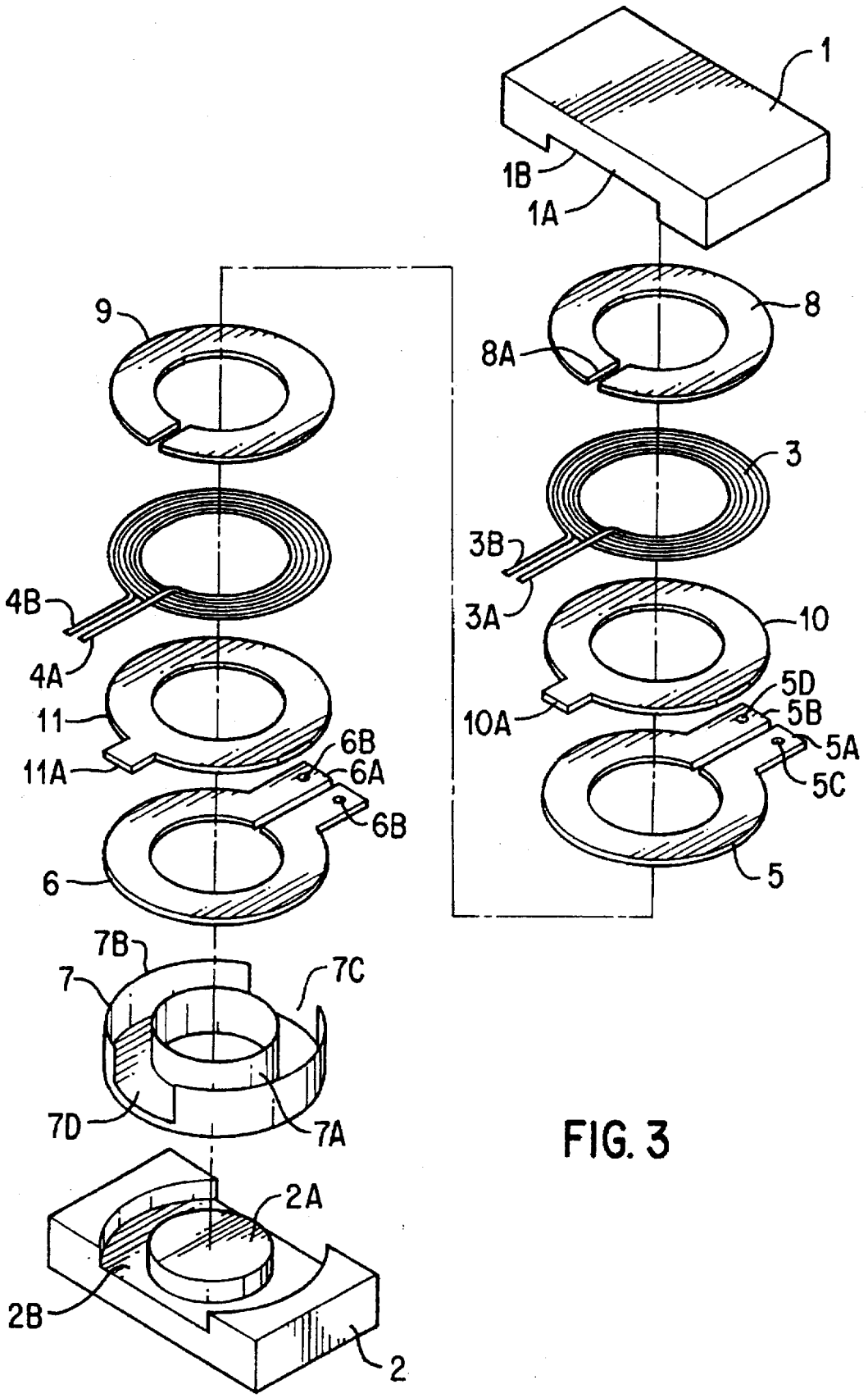
FIG. 3 is an exploded perspective view of a third embodiment of a power transformer according to the present invention.
Figure 4:
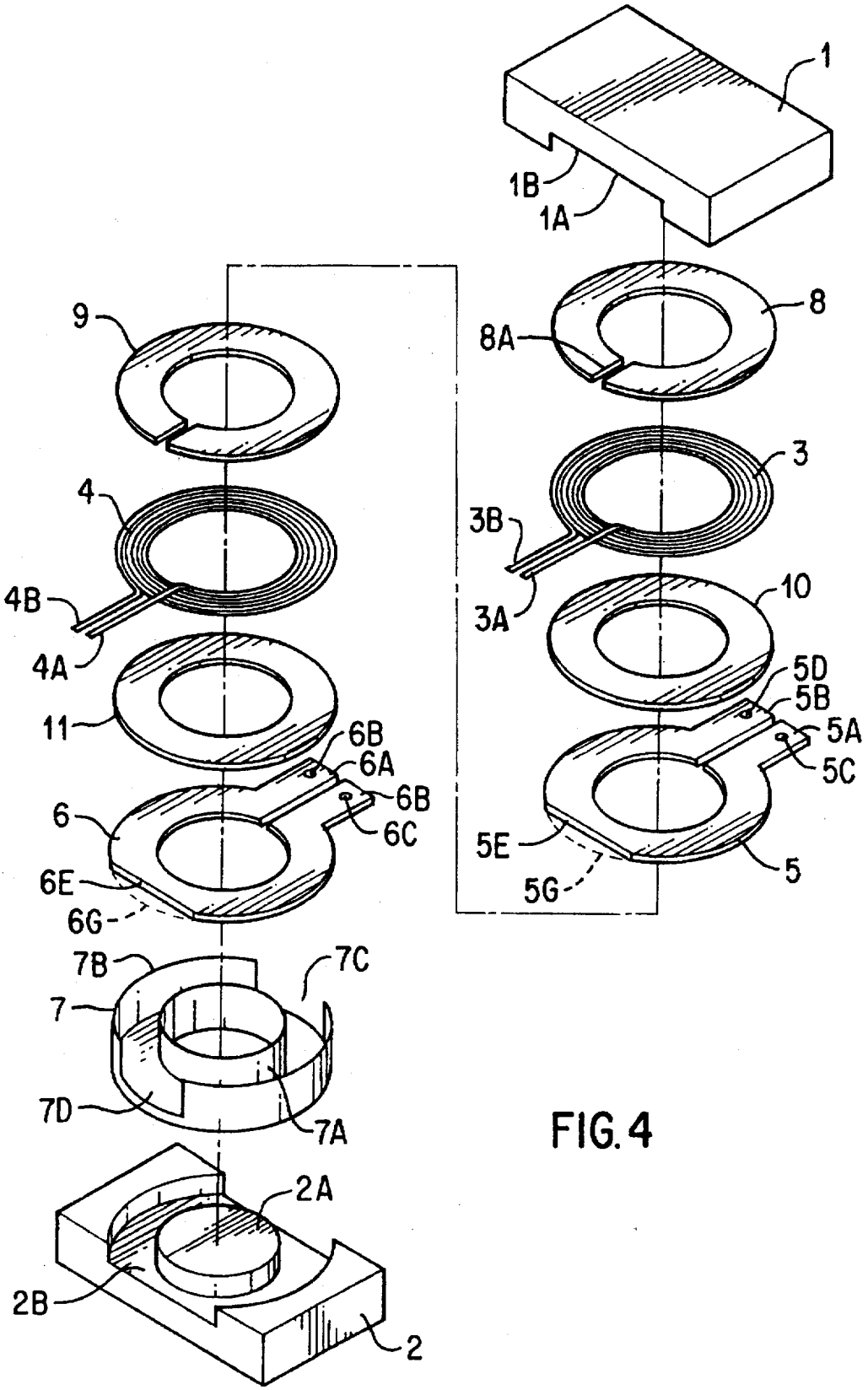
FIG. 4 is an exploded perspective view of a fourth embodiment of a power transformer according to the present invention.

FIGS. 3 and 4 are exploded perspective views of third and fourth embodiments of the power transformer according to the present invention.

Figure 8:
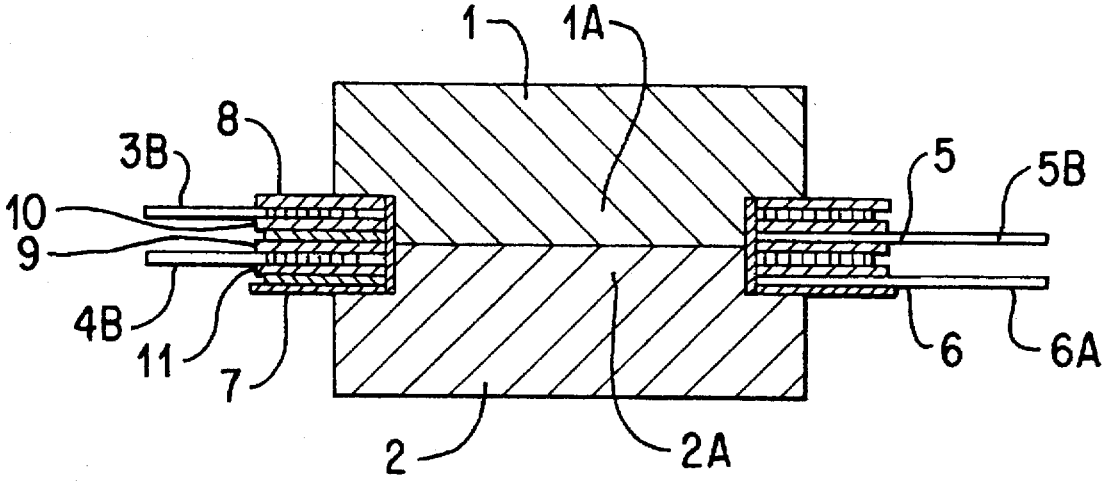
FIG.8 PRIOR ART
FIG. 8 is a sectional view of the power transformer of FIG. 7.
Figure 7:
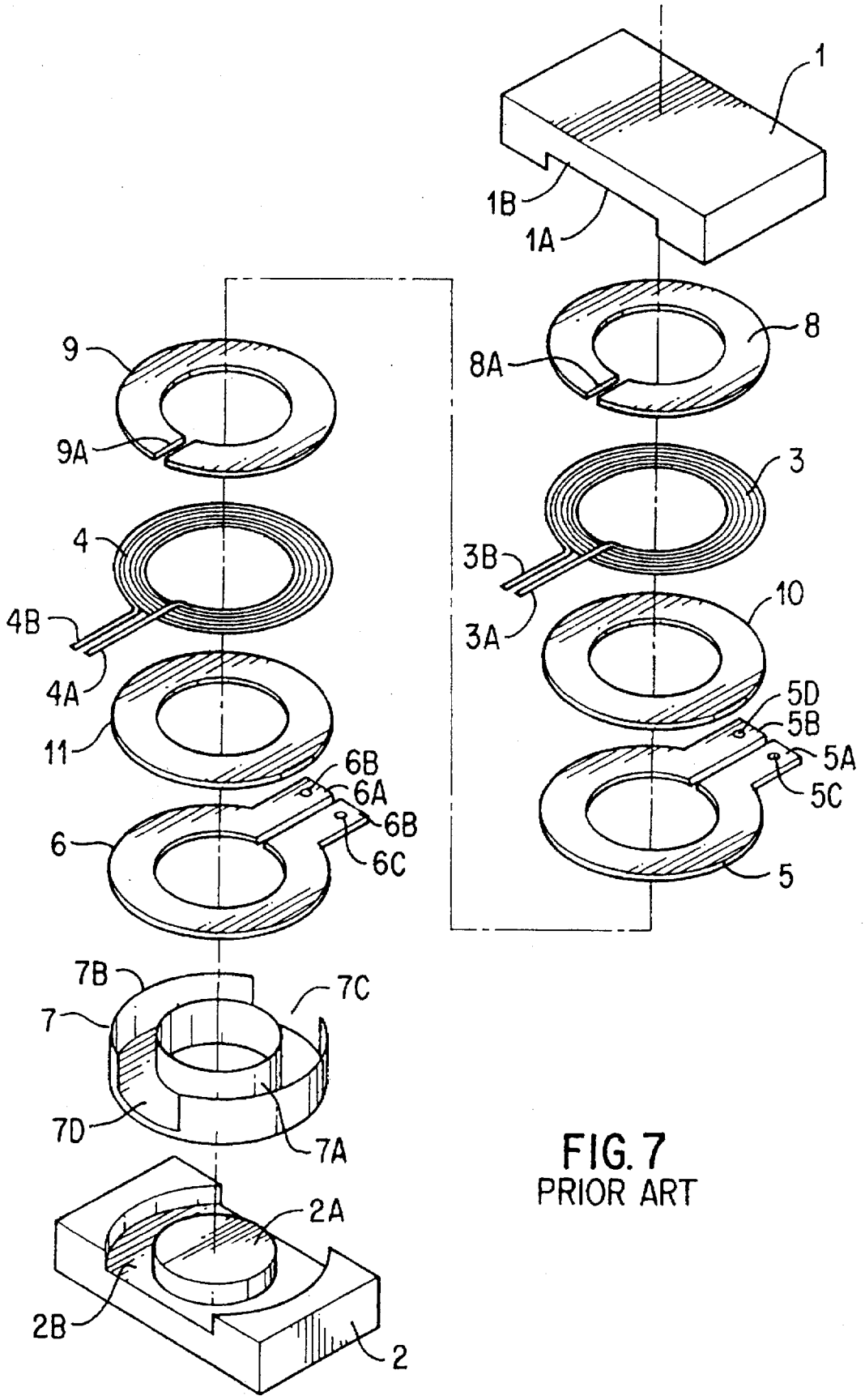
FIG. 7 PRIOR ART
FIG. 7 is an exploded perspective view of another conventional power transformer.

In the power transformer of FIG. 3, protrusions 10A and 11A are formed on the outer peripheries of the spacers 10 and 11 of the conventional power transformer of FIGS. 7 and 8.

In the power transformer of FIG. 4, portions 5G and 6G are cut out from the halved secondary windings 5, 6 respectively. The cut-out portions 5G and 6G face the leading portions 3A, 3B and 4A, 4B of the halved primary windings 3 and 4 through the spacers 10 and 11, respectively.

The functions and effects of the third and fourth embodiments are the same as those of the first and second embodiments.

According to the present invention, defective insulation is prevented and the reliability of the power transformer is improved since the insulation layers formed on the leading portions of the primary winding is not damaged by the burrs left on the cut surface of the secondary winding.

What is claimed is:

1. A power transformer, comprising:

a pair of cores, each having a protruding portion and a wiring storage portion surrounding the protruding portion, said cores being arranged such that the protruding portions and the wiring storage portions face against each other;

at least one primary winding formed of a spirally wound flat ring having a pair of primary leading portions;

at least one secondary winding formed of a flat plate and having a cut-out portion at a periphery of the flat plate, said cut-out portion being located under the flat ring near the primary leading portions when the power transformer is assembled so that an edge of the flat plate for the cut-out portion does not cause damage to the primary leading portions;

at least one spacer interposed between the flat ring and the flat plate; and an insulation member mounted in the wiring storage portions of the cores for housing the flat ring, the flat plate and the at least one spacer for insulating the flat ring and the flat plate, said insulation member insulating the housed primary winding and the secondary winding from the cores and having an opening for allowing the primary leading portions to pass therethrough.

2. A power transformer according to claim 1, wherein said flat ring, flat plate and at least one spacer have substantially same sizes, said cut-out portion being located under the spacer.

3. A power transformer according to claim 1, wherein said at least one primary winding is formed of two primary winding sections; and said at least one secondary winding is formed of two secondary winding sections, each secondary winding section being formed of a flat plate section and having a cut-out section at a periphery of the flat plate section, each of the spacers being situated between the primary winding section and the secondary winding section.

4. A power transformer according to claim 1, wherein said primary leading portions of the spirally wound flat ring have insulation layers, said insulation layers being protected from damage by the edge of the flat plate.

* * * * *

UNITED STATES PATENT AND TRADEMARK OFFICE

CERTIFICATE OF CORRECTION

PATENT NO. : 5,684,445

DATED : November 4, 1997

INVENTOR(S) : Yasuo Kobayashi; Koichi Ueki

It is certified that error appears in the above-indentified patent and that said Letters Patent is hereby corrected as shown below:

Column 4, line 46, change "is" to --are--

Signed and Sealed this

Nineteenth Day of May, 1998

*Attest:*

*Attesting Officer*

BRUCE LEHMAN

*Commissioner of Patents and Trademarks*